US008137071B2

(12) United States Patent
Caucheteux et al.

(10) Patent No.: US 8,137,071 B2
(45) Date of Patent: Mar. 20, 2012

(54) DAMPER FOR TURBOMACHINE VANES

(75) Inventors: Mathieu Caucheteux, Creteil (FR); Goran Durdevic, Montrouge (FR); Eric Lefebvre, Champigny (FR)

(73) Assignee: SNECMA, Paris (FR)

( * ) Notice: Subject to any disclaimer, the term of this patent is extended or adjusted under 35 U.S.C. 154(b) by 1184 days.

(21) Appl. No.: 12/109,810

(22) Filed: Apr. 25, 2008

(65) Prior Publication Data

US 2009/0010762 A1 Jan. 8, 2009

(30) Foreign Application Priority Data

Apr. 27, 2007 (FR) ..... 07 03106

(51) Int. Cl.
*F01D 5/26* (2006.01)

(52) U.S. Cl. ..... 416/193 A; 416/140; 416/500

(58) Field of Classification Search ..... 415/119; 416/135, 140, 190, 193 A, 221, 500
See application file for complete search history.

(56) References Cited

U.S. PATENT DOCUMENTS

| | | | | |
|---|---|---|---|---|
| 4,494,909 | A * | 1/1985 | Forestier | 416/190 |
| 4,516,910 | A * | 5/1985 | Bouiller et al. | 416/190 |
| 4,900,165 | A * | 2/1990 | Kun et al. | 384/220 |
| 5,261,790 | A | 11/1993 | Dietz et al. | |
| 5,284,011 | A * | 2/1994 | Von Benken | 60/796 |
| 5,369,882 | A * | 12/1994 | Dietz et al. | 29/889.1 |
| 5,803,710 | A * | 9/1998 | Dietrich et al. | 416/248 |
| 6,814,194 | B2 * | 11/2004 | Back et al. | 192/3.29 |
| 7,334,996 | B2 * | 2/2008 | Corbin et al. | 416/221 |

FOREIGN PATENT DOCUMENTS

| | | |
|---|---|---|
| EP | 0089272 A1 | 9/1983 |
| EP | 0095409 A1 | 11/1983 |
| EP | 1291492 | 3/2003 |
| FR | 2759096 | 8/1998 |

* cited by examiner

*Primary Examiner* — Edward Look
*Assistant Examiner* — Liam McDowell
(74) *Attorney, Agent, or Firm* — Oblon, Spivak, McClelland, Maier & Neustadt, L.L.P.

(57) ABSTRACT

A turbomachine vane damper constructed so as to be housed between the lower face of the platforms of two adjacent turbomachine vanes and the rim of the rotor disk on which the vanes are mounted is disclosed. The damper includes a weight, a bearing plate and a spring. The spring connects the weight to the bearing plate.

13 Claims, 5 Drawing Sheets

DAMPER FOR TURBOMACHINE VANES

The present invention relates to turbomachines comprising at least one rotor disk provided with vanes on the rim, and concerns a dynamic damper mounted underneath the vane platform. It is more particularly concerned with axial compressors.

BACKGROUND OF THE INVENTION

A turbomachine for which the invention is intended is an axial compressor or an axial turbine of the type comprising at least one rotor disk with housings recessed into its rim for vanes which extend radially relative to the axis of the machine. The vanes themselves comprise a root, an airfoil and, between the two, a platform. The root is inserted into the housing of the disk, the airfoil is swept by the flow of propellant gases and the platform forms a portion of the radially inside surface of the gas stream.

The purpose of dynamic damping is to modify the dynamic behavior of the vanes of the turbomachine by adding a mass underneath the platforms of the vanes. The loads thus generated in operation reduce the dynamic stresses in the roots of the vanes by changing the natural vibration frequencies.

DESCRIPTION OF THE PRIOR ART

Several types of dampers are known, including bonded dampers and fitted dampers: bonded dampers are fixed directly by bonding them to the inner surface of the platforms, meaning the surface nearest the axis of the machine. With this approach there is no problem of fitting. It does however require that the weights be positioned accurately before being bonded and that the adhesive be strong enough to prevent the dampers being lost during operation.

Fitted dampers are mounted between the vanes. During operation they experience centrifugal forces and are immobilized radially by the platforms of the vanes. This system requires an appropriate environment, accessible in such a way as to allow the dampers both to be fitted and held in position. Unlike the previous solution, losses of dampers do not occur because there is no bonding. On the other hand, problems of wear can occur due to rubbing of the parts against each other.

The object of the Applicant was to improve the technology of fitted dampers in two respects:

- make it possible to fit them in an environment where access is difficult, such as the first moving wheel of a high-pressure compressor;
- reduce wear caused by relative friction by closing the gaps between the various parts of the environment in contact with the damper.

It is possible with the invention to produce a damper that meets these requirements.

SUMMARY OF THE INVENTION

A turbomachine vane damper, in accordance with the invention, designed to be housed between the lower face of the platforms of two adjacent turbomachine vanes and the rim of the rotor disk on which the vanes are mounted, comprises a weight, a bearing plate shaped to bear on said rim, and a spring, the spring connecting the weight to the bearing plate, and at least the weight being made of a composite material.

The solution of the invention by the spring function makes it possible to devise a damper whose shape enables it to be installed in poorly accessible spaces and have it hold in place with less friction and less risk of wear.

In one embodiment the weight comprises a surface portion for contact with the platforms, said surface portion forming, when the spring is at rest, an angle of less than 90° with the bearing plate, said angle being determined by the angle between the inner face of the platforms and the rim. The shape of the damper is thus a deformable wedge which is easy to manipulate.

More particularly, the spring is a leaf joined at one end to the weight and to the bearing plate at its other end.

Since the weight is made of a composite material, this material allows a wide range of densities of the weight while offering great flexibility of shape. More specifically the material is an impregnated textile. The spring part of the damper may be distinguished from the weight part in the choice of materials used and their structure.

The weight may, according to the requirements, comprise at least one insert whose density is different than the density of the impregnated material. The insert is determined on the basis of the desired density of the damper. It may for example be a metal insert if the density is to be increased, or a foam-based material if the density is instead to be reduced.

To facilitate fitting, the damper comprises on at least one free end of the bearing plate or of the weight a leaf portion forming a stop or a fixing hook.

Another feature is that the mass of the damper is adjusted in such a way as to be interchangeable without requiring rebalancing of the rotor on which it is mounted. The mass is adjusted by simply removing material from the region of the center of gravity of the weight.

If necessary, the mass of the damper can be further adjusted by using a second weight continuing on from said weight on the spring side.

The Applicant also seeks to protect a turbomachine rotor comprising a rim with individual cells and vanes comprising a root housed in the cells, an airfoil and a platform between the root and the airfoil, in which dampers as defined above are housed in the spaces between the rim and two platforms of two adjacent vanes. In order to get the benefit of such a structure the damper springs are prestressed during fitting.

BRIEF DESCRIPTION OF THE DRAWINGS

An embodiment of the invention will now be described in greater detail with reference to the accompanying drawings, in which.

DESCRIPTION OF THE PREFERRED EMBODIMENTS

Figure 1:
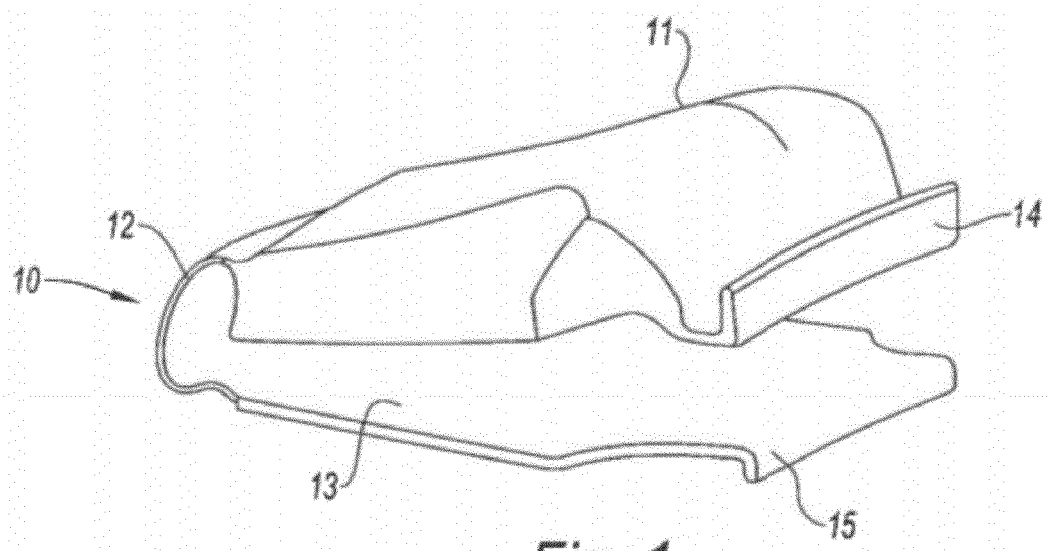
FIG. 1 is a cavalier perspective view of a damper of the invention.
Figure 2:
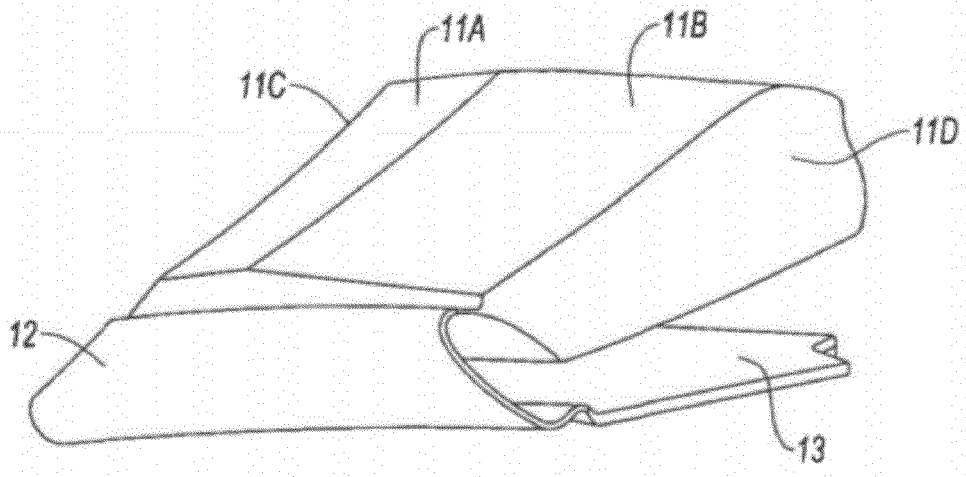
FIG. 2 shows the same damper seen from another angle.

FIGS. 1 and 2 are perspective views of a damper 10 according to the invention. It comprises a weight 11, a spring 12 and a bearing plate 13. The weight is of a shape suited to the environment in which the damper is intended to be installed. In this example the weight is of an elongate shape for fitting into the unoccupied space between two adjacent vanes of a compressor of a gas turbine engine, underneath the platforms of the two vanes. The weight has two surfaces 11A and 11B for contact with the platforms, and two lateral surfaces 11C and 11D. The weight 11 is continued at one end by a spring 12 in the form of a leaf curved around an axis perpendicular to the longitudinal direction of the weight. The spring leaf 12 is connected to a flat bearing plate in the form of a leaf. In the example illustrated, the weight forms an angle with the plane of the bearing plate when the spring is at rest and unstressed. The ends of both the weight and the bearing plate furthest from the spring each comprise a hooked leaf 14 and 15, respectively.

Figure 3:
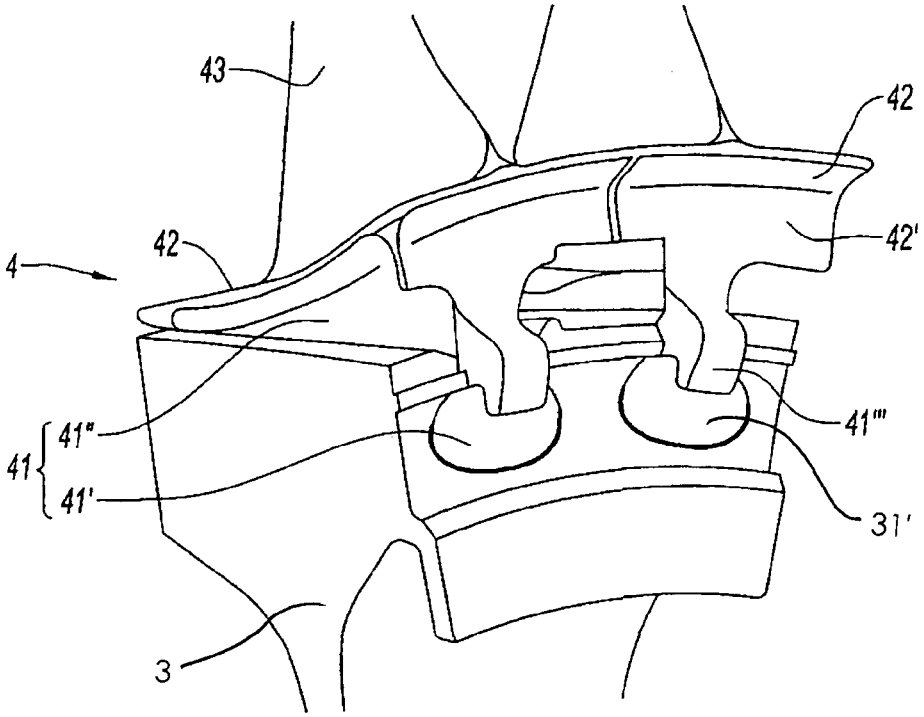
FIG. 3 shows the damper of the invention in place in an axial compressor rotor of a gas turbine engine, the rotor being shown in a partial view, in perspective.
Figure 4:
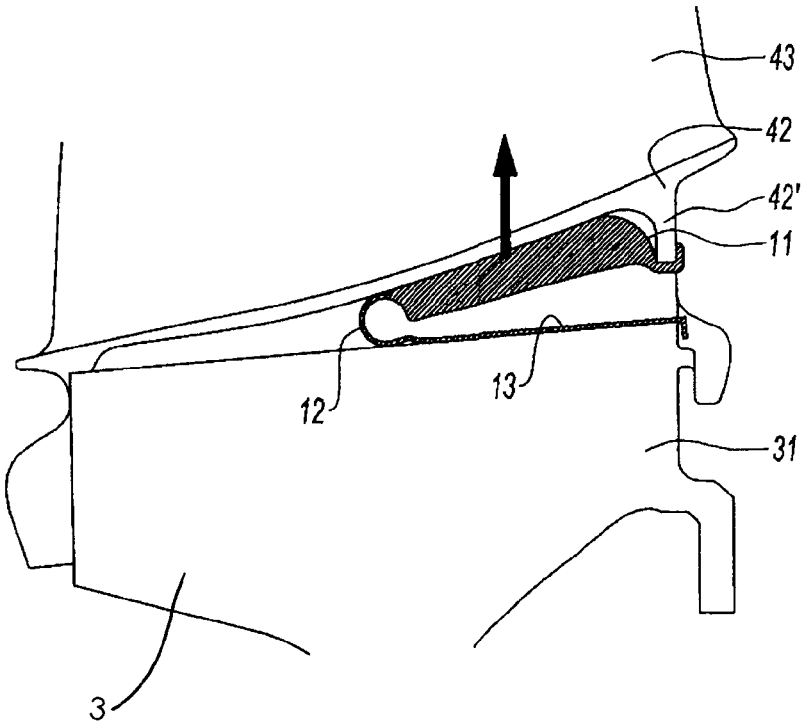
FIG. 4 shows the damper in place as in FIG. 3, the rotor being seen in section on a radial plane containing the rotor axis.

FIGS. 3 and 4 show the damper in place in a turbomachine rotor. In accordance with the example, this is a compressor rotor 2, known per se, viewed in FIG. 3 from the downstream end when considering the direction of flow of the gases. This rotor 2 is composed of a disk 3 with a plurality of vanes 4 around its periphery. The rim 31 has a plurality of basically axial cells 31' distributed around its perimeter. In this example the cells 31' are dovetail-sectioned.

The vanes 4 have a root 41, a platform 42 and an airfoil 43. The root is dovetail-sectioned in its lower part 41' to fit the dovetail shape of the cells. The cells thus have bearing surfaces for the radial retention of the vanes against centrifugal forces. The root also comprises a leg 41" under the platform 42. This leg is provided with a hook 41'" oriented in the downstream direction. This hook engages with a ring (not shown) which engages with the downstream face of the rim to lock the vanes axially. Locking can also be achieved using blocks underneath the vane between the root and the bottom of the cell. As seen in FIGS. 3 and 4, the platforms 42 are angled relative to the rim surface. This example is a compressor where the platforms define the reduction in cross section of the air stream undergoing compression. A transverse rib 42' extends radially under the platform 42 toward the axis of the rotor on the downstream side of the vane.

The damper 10, in place between two adjacent vanes, is positioned in the space defined underneath the two platforms 42 between the rim 31 and the two legs 41". The spring 12 is designed to be under tension so that the weight 11 is permanently pressed against the platforms 42. By reaction, the bearing plate bears against and is pressed against the rim 31. The two hooked leaves 14 and 15 are constructed in such a way as to engage, one 14 under the radial rib 42', and the other 15 against the downstream edge of the rim 31. In FIG. 3, all that can be seen of the damper is the two hooked leaves 14 and 15, which thus prevent incorrect assembly. A single glance is thus enough to check whether they are absent or incorrectly fitted. It will be understood that the surfaces 11A, 11B, 11C and 11D coming into bearing contact with the vanes are shaped accordingly.

Figure 5:
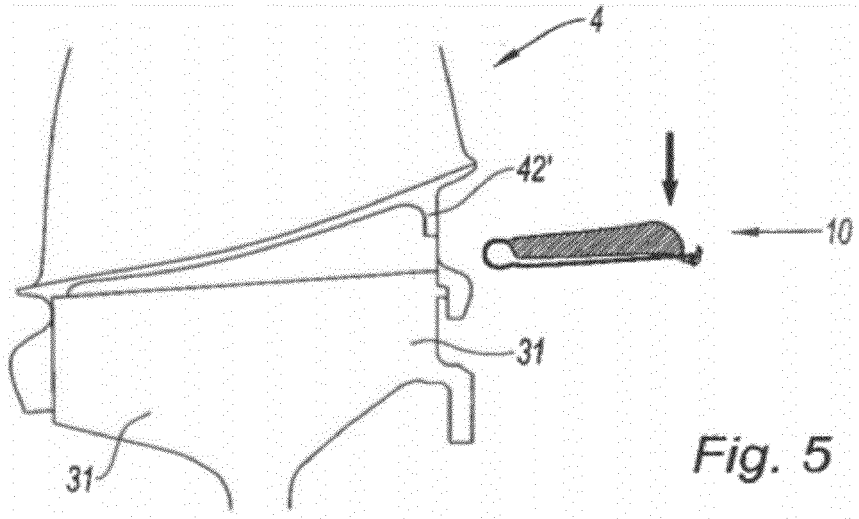
FIGS. 5, 6 and 7 show the steps of fitting the damper to the rotor of FIGS. 3 and 4.
Figure 6:
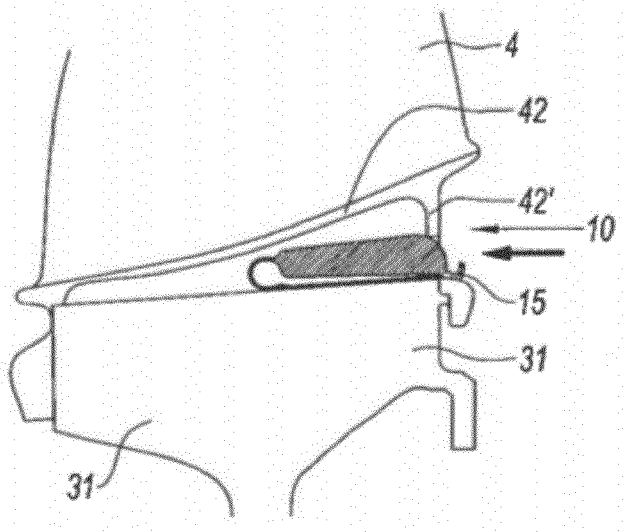
Figure 7:
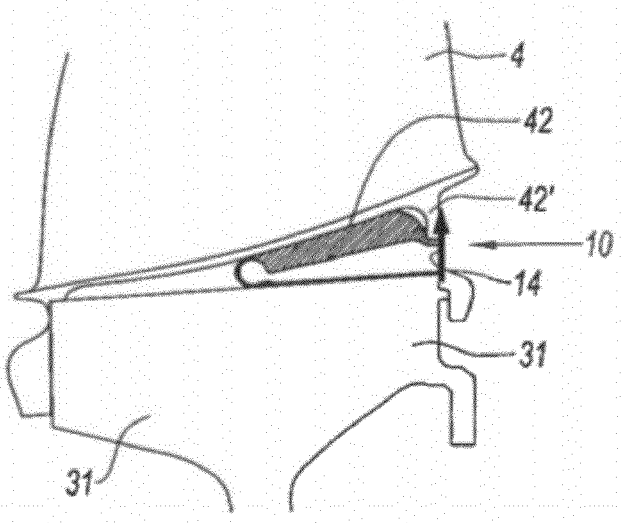

FIGS. 5, 6 and 7 show the steps in fitting the damper. It can be seen that the gap between the radial rib 42' and the rim 31 of the disk is small. All that is required is to squeeze the damper so that the weight touches the bearing plate. In this configuration the damper can be slid into the gap in the direction of the arrow, FIG. 6. When the damper is sufficiently engaged, the spring forces the weight against the platforms 42 in the direction of the arrow shown in FIG. 7. The hook 14 also hooks onto the rim and the leaf 15 bears against the edge of the rim 31.

The damper is preferably made of a composite material. The method of manufacture involves making a stack of several layers of organic resin-impregnated fabrics in a mold. The resin is then cured in an autoclave.

The material can be made from a preformed structure of resin-injected woven fibers using a process such as that described in patent FR 2 759 096 in the Applicant's name. The structure may be of 2D type (D for dimension), 3D type, or indeed of the so-called 2.5D type. The fibers may be based on a single material or on varying materials, such as a mixture of carbon fibers with glass fibers or fibers known under the trademark Kevlar®.

The whole damper may be made in one piece or may be made out of several separate parts assembled together. The materials may differ. For example, the fibers forming the structure of the spring part and/or bearing plate may differ from the part forming the weight. The choice is determined by the properties which it is desired to give to one part as compared with another.

Figure 8:
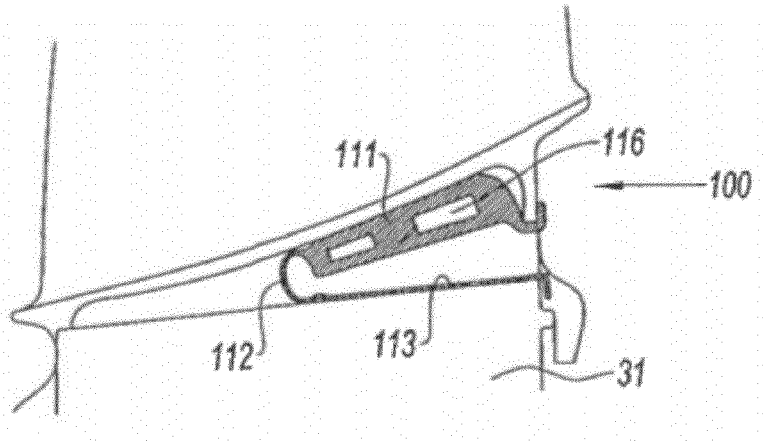
FIG. 8 shows a variant of the damper with inserts.

As a variant, see FIG. 8, one or more inserts 116 are incorporated in the fibrous structure of the weight 111 of the damper 100 to achieve the desired density. A metal insert will increase the density; an insert of cellular structure, in the form of a foam, will reduce the density of the weight. In other respects the structure of the damper, spring 112 and bearing plate 113 does not differ from the damper 10.

Figure 9:
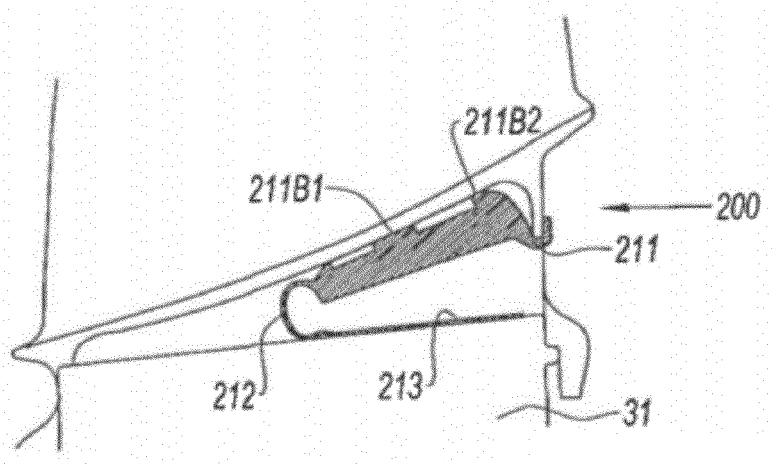
FIG. 9 shows a variant with modified contact surface.

FIG. 9 shows another variant of a damper 200 in which the surface area in contact with the platforms has been reduced to regions such as 211B1 and 211B2 of reduced size located along the length of the weight so that the surface portion of the weight includes grooves 211. The aim is to localize the load on the vane platforms in order to improve the damper's effectiveness. These regions may be made by machining the surface of the weight 211.

Figure 10:
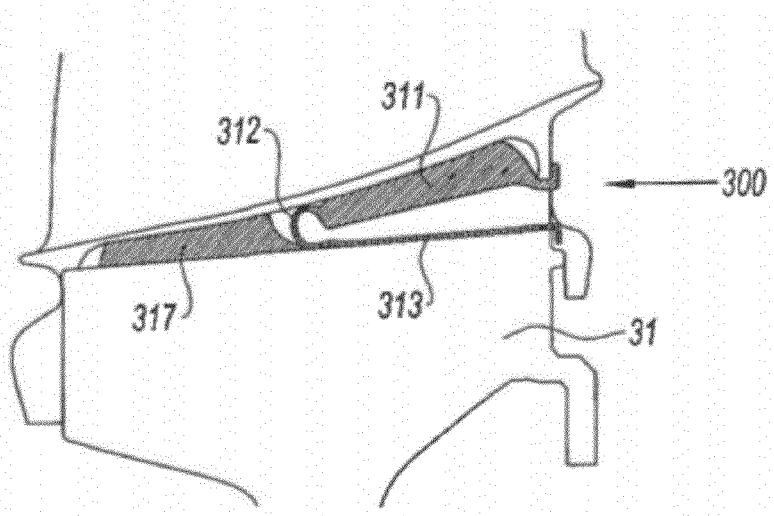
FIG. 10 shows another variant with an additional weight.

FIG. 10 shows another variant of the damper according to the invention. The damper 300 comprises an additional weight 317 connected to the spring 312 further ahead than the weight 311. This version makes it possible where required to distribute the dynamic damping loads along the platform of the vanes. The damper 300 can be made in one piece like the previous embodiments or in several parts joined together.

Figure 11:
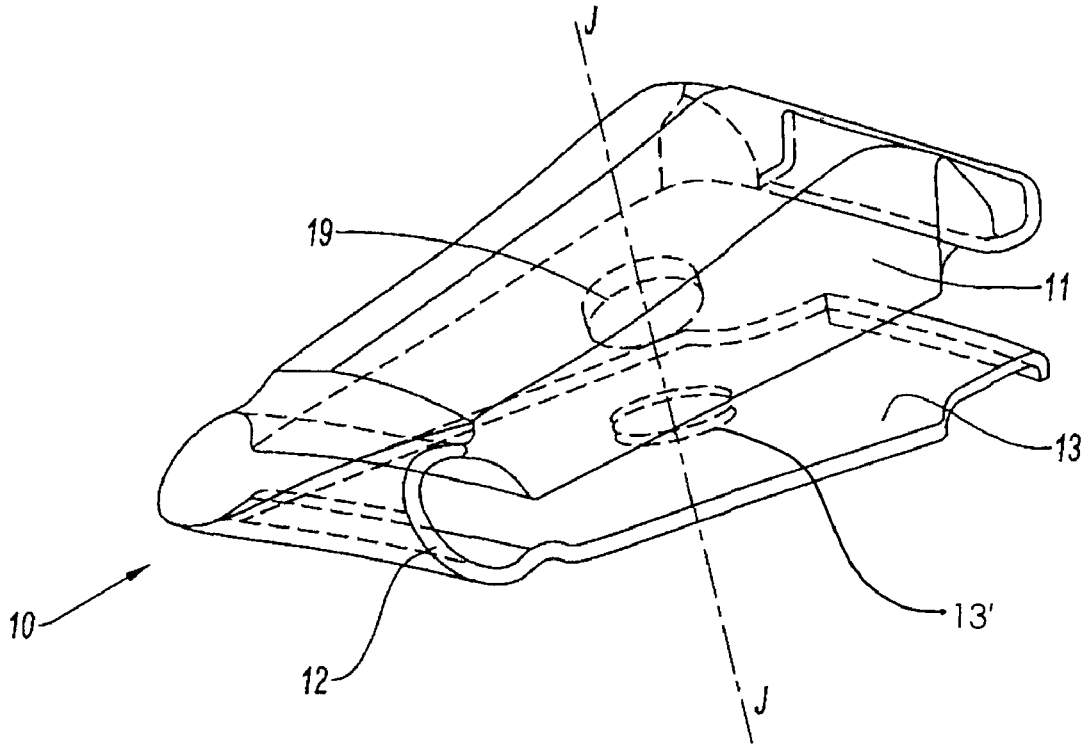
FIG. 11 shows an adjustment of the weight of the damper.

The structure of the damper is such that its mass can be adjusted with great precision. Advantageously the mass of the weight is adjusted by removing material by cutting a cavity around the center of gravity in the axis of inertia of the weight, as seen in FIG. 11. The bearing plate is pierced at 13' and the cavity 19, shown in dashed lines, is cut along the axis of inertia J. This adjustment makes it possible to produce dampers of identical mass accurate to 0.5 g. In order to provide a margin of correction and facilitate this adjustment of the mass, surplus material is provided during manufacture around the center of gravity. All dampers produced in this way are interchangeable with each other. This makes it possible to limit mass distribution differences likely to cause unbalance in the rotor.

The invention claimed is:

1. A turbomachine vane damper designed to be housed between a lower inner face of platforms of two adjacent turbomachine vanes and an outer periphery of a rim of a rotor disk on which the vanes are mounted, said damper comprising:

a weight including a surface portion which abuts the lower inner face of the platforms of the two adjacent vanes;

a flat bearing plate which abuts the outer periphery of the rim; and a spring connecting the weight to the bearing plate, the spring being a leaf joined at a first end to the weight and at a second end to the bearing plate, wherein the weight is made of a composite material, wherein the surface portion forms, when the spring is at rest, an angle of less than 90° with the bearing plate, the angle being determined by the angle between the lower inner face of the platforms and the outer periphery of the rim, and wherein a first hook is provided at a second end of the weight and a second hook is provided at a second end of the bearing plate, the first hook facing upward and cooperating with a transverse rib of the vanes such that a radially inner free end of the transverse rib abuts a groove of the first hook and the second hook cooperating with a downstream edge of the outer periphery of the rim.

2. The damper as claimed in claim 1, wherein the material of the damper is an impregnated textile.

3. The damper as claimed in claim 2, wherein the weight comprises at least one insert with a density that is different than a density of the impregnated textile, the density of the insert being determined on a basis of the desired density of the damper.

4. The damper as claimed in claim 3, wherein the insert is metallic or is of a foam structure.

5. The damper as claimed in claim 1, wherein a mass of the weight is adjusted in such a way that the damper is interchangeable without requiring rebalancing of the rotor on which the damper is mounted.

6. The damper as claimed in claim 1, further comprising a second weight continuing on from said weight on the spring side.

7. The damper as claimed in claim 1, wherein the surface portion of the weight includes grooves.

8. A turbomachine rotor comprising:

a rim with individual cells and vanes comprising a root housed in the cells;

an airfoil; and a platform between the root and the airfoil, wherein dampers each comprising a turbomachine vane damper designed to be housed between a lower inner face of platforms of two adjacent turbomachine vanes and an outer periphery of a rim of a rotor disk on which the vanes are mounted, each said damper comprising:

a weight including a surface portion which abuts the lower inner face of the platforms of the two adjacent vanes;

a flat bearing plate which abuts the outer periphery of the rim; and a spring connecting the weight to the bearing plate, the spring being a leaf joined at a first end to the weight and at a second end to the bearing plate, wherein the weight is made of a composite material, wherein the surface portion forms, when the spring is at rest, an angle of less than 90° with the bearing plate, the angle being determined by the angle between the lower inner face of the platforms and the outer periphery of the rim, and wherein a first hook is provided at a second end of the weight and a second hook is provided at a second end of the bearing plate, the first hook facing upward and cooperating with a transverse rib of the vanes such that a radially inner free end of the transverse rib abuts a groove of the first hook and the second hook cooperating with a downstream edge of the outer periphery of the rim, the dampers are housed in spaces between the rim and two platforms of two adjacent vanes.

9. The turbomachine rotor as claimed in claim 8, wherein the damper springs are prestressed during fitting.

10. A compressor for a gas turbine engine comprising a turbomachine rotor comprising:

a rim with individual cells and vanes comprising a root housed in the cells;

an airfoil; and a platform between the root and the airfoil, wherein dampers each comprising a turbomachine vane damper designed to be housed between a lower inner face of platforms of two adjacent turbomachine vanes and an outer periphery of a rim of a rotor disk on which the vanes are mounted, each said damper comprising:

a weight including a surface portion which abuts the lower inner face of the platforms of the two adjacent vanes;

a flat bearing plate which abuts the outer periphery of the rim; and a spring connecting the weight to the bearing plate, the spring being a leaf joined at a first end to the weight and at a second end to the bearing plate, wherein the weight is made of a composite material, wherein the surface portion forms, when the spring is at rest, an angle of less than 90° with the bearing plate, the angle being determined by the angle between the lower inner face of the platforms and the outer periphery of the rim, and wherein a first hook is provided at a second end of the weight and a second hook is provided at a second end of the bearing plate, the first hook facing upward and cooperating with a transverse rib of the vanes such that a radially inner free end of the transverse rib abuts a groove of the first hook and the second hook cooperating with a downstream edge of the outer periphery of the rim, the dampers are housed in spaces between the rim and two platforms of two adjacent vanes.

11. The compressor for a gas turbine engine as claimed in claim 10, wherein the damper springs are prestressed during fitting.

12. A gas turbine engine comprising a turbomachine rotor comprising:

a rim with individual cells and vanes comprising a root housed in the cells;

an airfoil; and a platform between the root and the airfoil, wherein dampers each comprising a turbomachine vane damper designed to be housed between a lower inner face of platforms of two adjacent turbomachine vanes and an outer periphery of a rim of a rotor disk on which the vanes are mounted, each said damper comprising:

a weight including a surface portion which abuts the lower inner face of the platforms of the two adjacent vanes;

a flat bearing plate which abuts the outer periphery of the rim; and a spring connecting the weight to the bearing plate, the spring being a leaf joined at a first end to the weight and at a second end to the bearing plate, wherein the weight is made of a composite material, wherein the surface portion forms, when the spring is at rest, an angle of less than 90° with the bearing plate, the angle being determined by the angle between the lower inner face of the platforms and the outer periphery of the rim, and wherein a first hook is provided at a second end of the weight and a second hook is provided at a second end of the bearing plate, the first hook facing upward and cooperating with a transverse rib of the vanes such that a radially inner free end of the transverse rib abuts a groove of the first hook and the second hook cooperating with a downstream edge of the outer periphery of the rim, the dampers are housed in spaces between the rim and two platforms of two adjacent vanes.

13. The gas turbine engine as claimed in claim 12, wherein the damper springs are prestressed during fitting.

* * * * *